US006510578B1

(12) United States Patent
Cyr et al.

(10) Patent No.: US 6,510,578 B1
(45) Date of Patent: Jan. 28, 2003

(54) BRUSH HAVING REMOVABLE BRISTLE PACK

(76) Inventors: William F. Cyr, 592 Pond St., Franklin, MA (US) 02038; George E. Marotta, 164 Congress St., Milford, MA (US) 01757

( * ) Notice: Subject to any disclaimer, the term of this patent is extended or adjusted under 35 U.S.C. 154(b) by 0 days.

(21) Appl. No.: 09/556,193

(22) Filed: Apr. 21, 2000

(51) Int. Cl.[7] ..... A46B 3/00

(52) U.S. Cl. ..... 15/176.6; 15/176.1; 15/193; 15/202; 403/321; 403/329

(58) Field of Search ..... 15/176.1, 176.6, 15/DIG. 4, 194, 168, 177, 178, 193, 171, 176.5, 176.4, 191.1, 202, 204, 192; 403/329, 326, DIG. 14, 321

(56) References Cited

U.S. PATENT DOCUMENTS 2,900,654 A * 8/1959 Koltvedt ..... 15/176.6
4,754,516 A 7/1988 Tremblay ..... 15/176.1
5,218,733 A 6/1993 Leu ..... 15/146
5,289,606 A 3/1994 Ledingham ..... 15/168
5,359,749 A 11/1994 Chu ..... 15/176.1
5,435,037 A 7/1995 Ledingham ..... 15/176.6

* cited by examiner

*Primary Examiner*—Gary K. Graham
(74) *Attorney, Agent, or Firm*—D. Michael Burns

(57) ABSTRACT

A paint brush having a removable bristle pack which snaps on and off a handle portion by means of a resilient prong mounted pin. The present invention employs a slot in the ferrule of the bristle pack to receive with a friction fit the pin extending resiliently from the handle. In assembly the handle is merely inserted into the ferrule until the pin snaps into place, and the bristle pack can be removed for cleaning or changing by depressing the pin which will thereby cause the bristle pack to be disengaged.

1 Claim, 2 Drawing Sheets

BRUSH HAVING REMOVABLE BRISTLE PACK

BACKGROUND OF THE INVENTION

1. Field of the Invention

The present invention relates to a brush having a removable bristle pack that snaps on and off by the depression of a pin.

2. Description of the Prior Art

Conventional paint brushes have certain common disadvantages, wherein they are usually bound by an epoxy or some similar means and are permanently attached to a handle by means of a metal ferrule. After use the brushes must be cleaned, preserved or discarded. All options except discarding the brushes are made difficult by the manner in which the filaments or bristles, of whatever kind, whether natural or man made, are fixed to the handle. The dense collections of bristles present cleaning problems because of the manner in which the densely clustered bristles are permanently held to the handle by the ferrule. It is in this region of the ferrule where paint tends to build up within the bristles, and it is in this confined area where the paint is most difficult to clean. Over time and repeated use of the brush, a build up of paint collects in this area. This reduces the life of the brush since this paint build up will cause the bristles to prematurely wear and break.

To properly clean a paint brush requires a considerable amount of solvent, especially where oil based paints are used. The solvents are not only expensive but they can present an environmental pollutant. As each brush occurs an additional cleaning, the process increases in expense and takes longer to get the bristles properly cleaned. As a result many paint brushes are used only a few times, even after attempts at cleaning, and then discarded because of the hardening of residual paint in the bristles starting adjacent to the ferrule section.

There presently exists a large number of brushes having a removable handle and/or an interchangeable head for mounting of a bristle pack. Such brushes make it possible to replace the bristle pack at will either for adapting a bristle pack of desired width, replacing a worn out bristle pack or for cleaning the bristle pack.

U.S. Pat. No. 4,754,516, issued Jul. 5, 1988, to Tremblay, discloses a brush having a removable handle in the form of nippers and a head having a housing to receive the handle. This invention relies upon notches and detents in the housing and handle to latch the two components together. This invention requires the manufacture of a very intricate housing and handle, but does provide an easy release between the head and handle.

U.S. Pat. No. 5,359,749, issued Nov. 1, 1994, to Chu, teaches an improved technique for mounting the detachable bristle pack onto the paint brush handle, by means of an insertable pin that actually transverses the bristle pack. The pin is not an integral part of either the bristle pack or the handle. The design by Chu has the bristle pack insertable into an open handle portion thereby making it more difficult to paint in tight areas.

U.S. Pat. No. 5,218,733, issued to Leu, on Jun. 15, 1993, discloses a paint brush with releasable bristles but requiring the use of loose parts such as a thumb screw, washer and thumb nut.

U.S. Pat. Nos. 5,435,037 and 5,289,606, issued on Oct. 21, 1997 to Ledingham, depict brushes with detachable bristle packs. The bristle packs are all insertable into a cavity in the handle and with these patents the means for securing them are quite involved as shown by the many figures describing the inventions.

None of the above inventions and Patents, taken singly or in combination, is given to describe the instant invention as claimed.

SUMMARY OF THE INVENTION

The present invention relates to a paint brush having a replaceable bristle pack. The present invention relates specifically to a brush which is designed to have a bristle pack snap on and off a male type insertable handle.

An important object of the present invention is to provide a new and improved paint brush construction in which the back bound bristles are readily separable from the brush handle for exchange or cleaning.

Another object of the invention is to provide a new and improved paint brush construction in which the user only has to press an extruding pin to release the bristle pack into the cleaning solution or to discard.

An object of the invention is to have no loose parts which are not integrally connected to either the handle or the bristle pack.

A further object of the invention is to be able to manufacture the brush with the same conventional techniques as presently used to manufacture conventional paint brushes. That is to employ the same ferrule construction for holding the bristles and the same conventional handle. The only major mechanical difference (other than the present invention is removable) between a conventional paint brush and the present invention is a slot in the ferrule section of the bristle pack and a resilient extruding finger extending from the distal end of the handle. The finger having mounted thereon a pin which is locked into the slot of the ferrule portion when the handle is inserted.

A still further object of the present invention is the ease of cleaning the bristle portion, wherein only a fraction of the cleaning solution is required since the bristle portion can lie horizontally in a very shallow pool of solution.

Another object of the invention is to have interchangeability of brush types, whether they be latex, oil, natural filaments or throwaways.

Another object is to utilize the same concept for use of the handle portion with snap on putty knives, snap on wallpaper seam rollers, wallpaper glue pasters, snap on razors and many other applications related to painting and wallpapering.

And the most important object of the present invention is to provide a paint brush comprised of a bristle pack and a handle wherein neither has to be assembled nor require a third piece for insertion or removal of the bristle pack.

These and other objects of the present invention will become readily apparent upon further review of the following specification and drawings.

DETAILED DESCRIPTION OF THE PREFERRED EMBODIMENT

Figure 1:
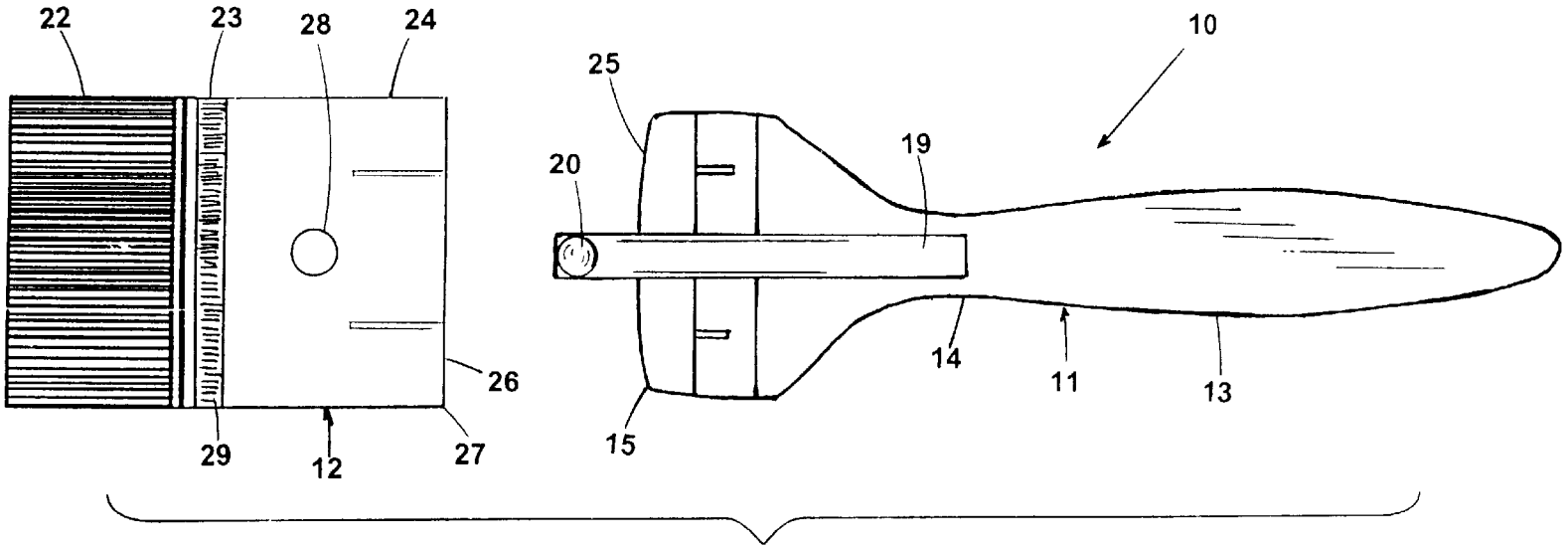
FIG. 1 is a top exploded view of the paint brush.

Referring to the drawings, FIGS. 1 to 4 illustrate various views of the paint brush 10 which comprises a handle 11 and a bristle pack 12. Handle 11 is formed by an elongate bulbous portion 13 having a conventional paint brush shape, one designed to provide a firm grip for the user, and having a relatively narrow neck 14 connecting an enlarged insertion end 15, in which the bristle pack 12 is removably mounted. A beveled area 25 on the forward portion of the insertion end 15 insures easy connection with bristle pack 12. Handle 11 is preferably molded from a plastic material, wood or light metal. Handle 11 having opposite walls, a top surface 16 and a bottom surface 17. At the insertion end 15 of handle 11, an elongated groove 18 is defined in the top surface 16. Disposed within the groove 18 is an elongated thin, ductile and resilient finger prong 19 integrally attached at one end within groove 18 of handle 11. Finger prong 19 will preferably be metal or a hard plastic, but will have a biasing spring-like action. At the other end of the finger prong 19 is an integral cylindrical pin 20, the use to be discussed further. The pin 20 will be of the same material as the finger prong 19. The bottom surface 17 will have disposed therein a flange 21 extending across its width in an area of close proximity to the insertion end 15. Flange 21 will have a degree of flexibility and will serve as a stabilizer and abutment for the mating of the handle 11 to the bristle pack 12. Flange 21 will generally be made from a metal or plastic.

Figure 2:
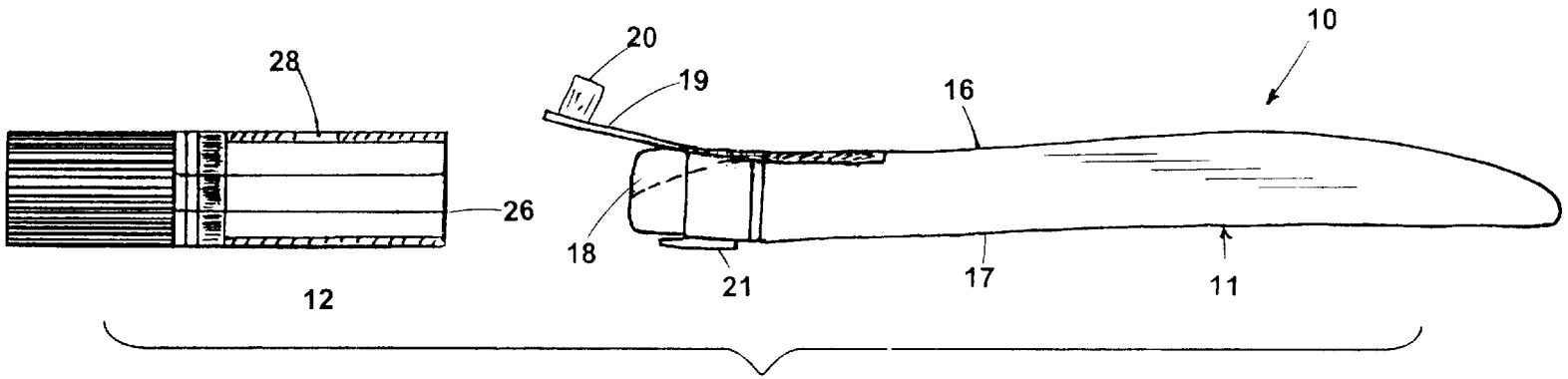
FIG. 2 is an exploded side view of the paint brush.
Figure 3:
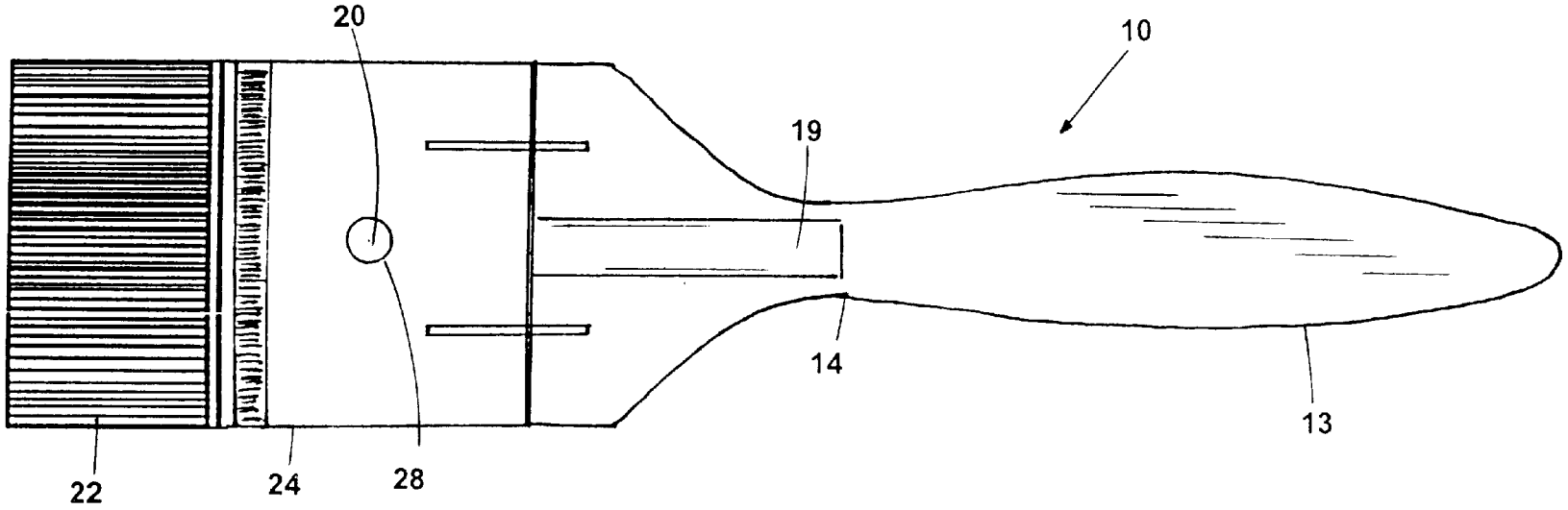
FIG. 3 is a top view of the paint brush, shown with the handle inserted into the bristle pack.

FIGS. 1 and 2 depict bristle pack 12 as being a conventional manufactured bristle pack. Bristle pack 12 having at its business end a group of bristles 22 which can be synthetic or natural filaments attached at their back end 23 by an epoxy or other adhesive and held within a forward end of a ferrule portion 24 by a crimping strip 29. Ferrule portion 24 has generally an open tubular body of generally rectangular cross-section with an opening 26 at the proximal end 27 for receiving handle 11. Normally the ferrule portion 24 is made of a light metal but can be a molded plastic. Insertion end 15 of handle 11 having a beveled perimeter 25 for easy insertion into opening 26. Top surface 16 of the ferrule portion 24 having defined therein a circular aperture 28 of a diameter and tolerance to accept insertion in a friction fit with pin 20. Pin 20 and aperture 28 are described as being circular but in actuality may be of any workable shape such as square, hexagonal, etc.

Figure 4:
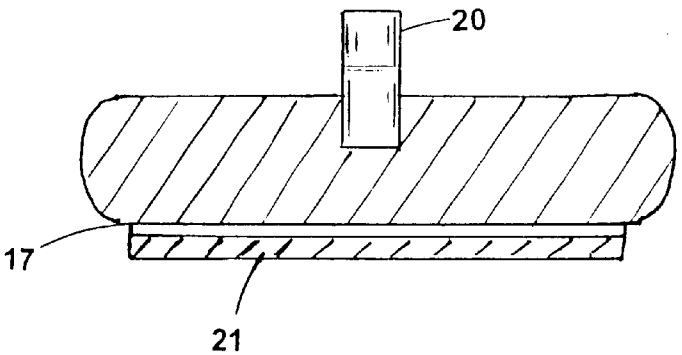
FIG. 4 is an end view of the handle portion.

During assembly, handle 11 is inserted within ferrule portion 24 of bristle pack 12 until a connection is made by the pin 20 biasly snapping into aperture 28. The finger prong 19 is forced to float within the groove 18 during insertion and is released from the groove 19 when the pin 20 is seated into the aperture 28 of the ferrule portion 24. Flange 21 acts as an abutment to bristle pack 12 and gives brush 10 an added measure of stability and support. FIGS. 2 and 4 depict flange 21 and its structural contribution to brush 10. The bristle pack 12 can be removed from handle 11 by simply depressing pin 20 back into the aperture 28 and allowing bristle pack 12 to slide off.

In manufacturing the instant invention, the only variables to the manufacture of a conventional paint brush are in providing the finger prong 19, groove 18 for seating of prong 19, flange 21 and aperture 28 within ferrule portion 24. The present invention eliminates one of the steps necessary in manufacturing conventional brushes, that being the permanent attachment of the handle to the bristle pack. The inventive concept of the present invention is in providing a paint brush with removable bristle pack, wherein the need for any accessory parts is eliminated. A minimum deviation from the manufacture of conventional paint brushes is thereby maintained for convenience and economics. Any manufacturer of a conventional paint brush would be able to convert to the manufacture of the present invention with a minimum of effort.

It will therefore be readily understood by those persons skilled in the art that the present invention is susceptible of broad utility and application. Many embodiments and adaptations of the present invention other than that herein described, as well as many variations, modifications and equivalent arrangements will be apparent from or reasonably suggested by the present invention and the foregoing description theeof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and eqivalents thereof.

LEGEND

10 Paint Brush
11 Handle
12 Bristle Pack
13 Elongated bulbous portion
14 Narrow neck
15 Insertion End
16 Top Surface
17 Bottom Surface
18 Elongated Groove
19 Resilient Finger Prong
20 Cylindrical Pin
21 Flange
22 Group of Bristles
23 Back end of Bristles
24 Ferrule Portion
25 Beveled Area
26 Opening in Proximal End of Ferrule Portion
27 Proximal End of Ferrule Portion
28 Aperture
29 Crimping Strip

What is claimed is:

1. A brush comprising:

a bristle pack removably connected to a handle;

the bristle pack having:

a group of bristles joined together at their back end;

a ferrule portion having a generally open rectangular cross section, a forward end of the ferrule portion integrally receiving the group of bristles, a proximal end removably receiving the handle;

the ferrule portion having a top surface;

an aperture defined in the top surface; and the handle having:

an elongated bulbous portion for gripping the brush, a relatively narrow neck connecting the bulbous portion to an enlarged insertion end of the handle;

the insertion end having a generally rectangularly cross section with a beveled forward area for friction fit within the ferrule portion;

the handle having a top surface and a bottom surface;

an elongate groove defined in the top surface of the handle;

an elongate resilient finger prong integrally attached at one end within the groove of the handle;

a pin integral with the other end of the finger prong of a size suitable for friction fitting within the aperture of the ferrule portion; and a flange transversing across the bottom surface and extending outwardly from the insertion end for providing an abutment to the ferrule portion and a stabilizer for the brush, whereby the brush can be assembled by inserting the handle into the ferrule portion of the bristle pack until the pin biasly snaps into the aperture, and disassembled by depressing the pin wherein the bristle pack will be disengaged from the handle.

* * * * *